US012077251B1

(12) United States Patent
Noble

(10) Patent No.: US 12,077,251 B1
(45) Date of Patent: Sep. 3, 2024

(54) OFFSHORE PLATFORM TENDON SUPPORT SYSTEM

(71) Applicant: NuEnergy Partners, LP, Beaumont, TX (US)

(72) Inventor: Thomas H Noble, Beaumont, TX (US)

( * ) Notice: Subject to any disclaimer, the term of this patent is extended or adjusted under 35 U.S.C. 154(b) by 424 days.

(21) Appl. No.: 17/570,148

(22) Filed: Jan. 6, 2022

Related U.S. Application Data

(63) Continuation-in-part of application No. 17/469,608, filed on Sep. 8, 2021, which is a continuation-in-part of application No. 17/102,014, filed on Nov. 23, 2020, now Pat. No. 11,591,051.

(60) Provisional application No. 63/076,156, filed on Sep. 9, 2020, provisional application No. 62/938,743, filed on Nov. 21, 2019.

(51) Int. Cl.
*B63B 21/50* (2006.01)
*B63B 39/02* (2006.01)

(52) U.S. Cl.
CPC ..... *B63B 21/502* (2013.01); *B63B 39/02* (2013.01)

(58) Field of Classification Search
CPC ..... B63B 21/00; B63B 21/502; B63B 39/00; B63B 39/02
USPC ..... 114/124
See application file for complete search history.

(56) References Cited

U.S. PATENT DOCUMENTS

| | | | | |
|---|---|---|---|---|
| 11,591,051 | B1 * | 2/2023 | Noble | B63B 39/00 |
| 2004/0028479 | A1 | 2/2004 | Horton, III | |
| 2004/0052586 | A1 | 3/2004 | Horton, III | |
| 2004/0161984 | A1 | 8/2004 | Lima de Almeida et al. | |
| 2004/0253059 | A1 | 12/2004 | Horton, III | |
| 2007/0212170 | A1 | 9/2007 | Hawley | |
| 2011/0083853 | A1 | 4/2011 | Pionetti | |
| 2015/0075417 | A1 | 3/2015 | Khachaturian | |
| 2019/0078556 | A1 | 3/2019 | Stiesdal | |

* cited by examiner

*Primary Examiner* — Lars A Olson
(74) *Attorney, Agent, or Firm* — Werner IP Law, P.C.

(57) ABSTRACT

A tendon support system has a floatation assembly and a tethering assembly. The tendon support system is capable of installing multiple tendons to an offshore platform while minimizing the chances that the tendons will tangle or otherwise become entwined.

23 Claims, 6 Drawing Sheets

FIG.2
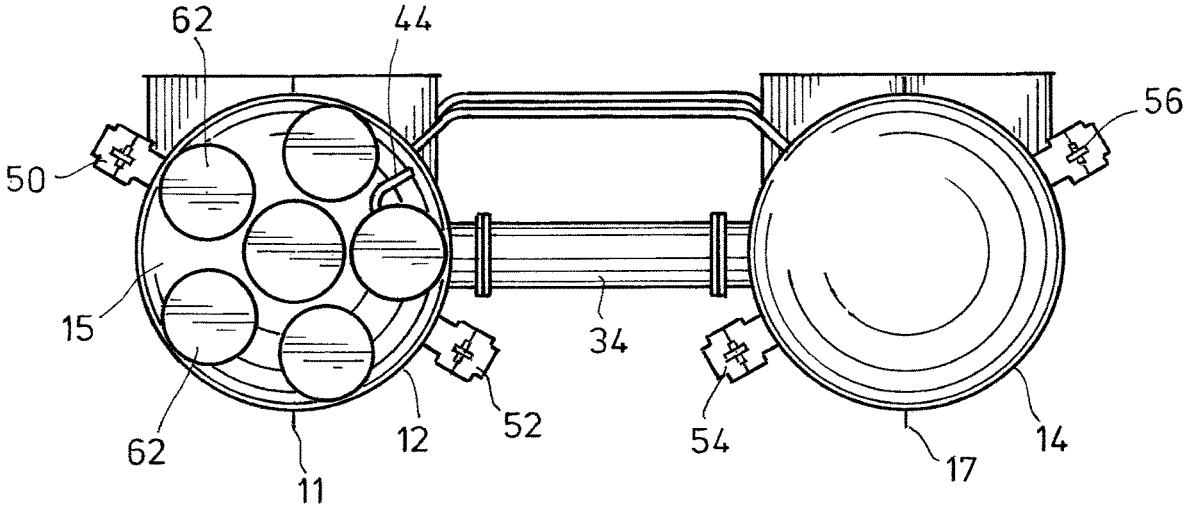
FIG.5
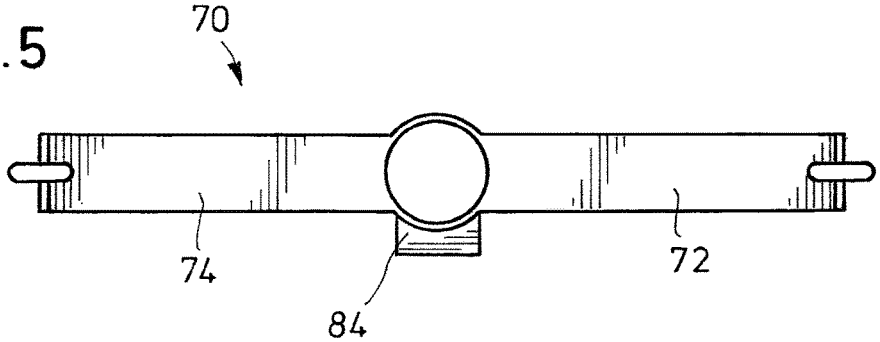
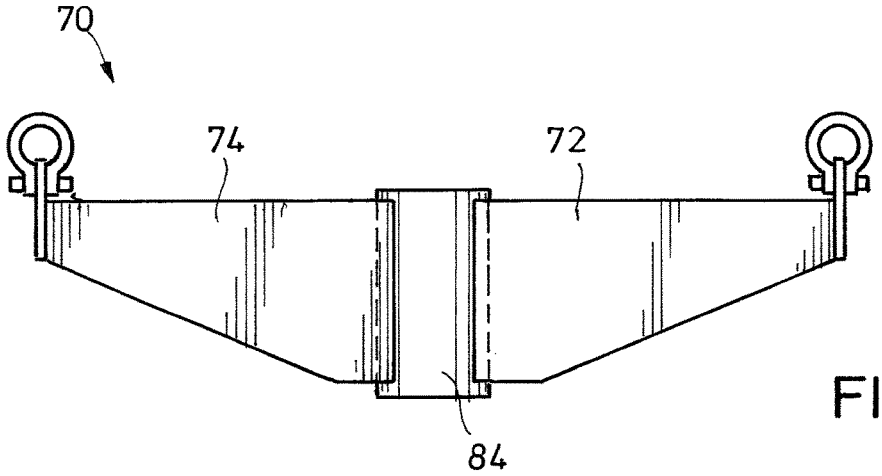
FIG.4

OFFSHORE PLATFORM TENDON SUPPORT SYSTEM

CROSS REFERENCE TO RELATED APPLICATION

This application is a continuation-in-part of U.S. application Ser. No. 17/469,608 filed Sep. 8, 2021, which in turn claims priority to U.S. Application No. 63/076,156 filed Sep. 9, 2020 and is a continuation-in-part of U.S. application Ser. No. 17/102,014 filed Nov. 23, 2020, which in turn claims priority to U.S. Application No. 62/938,743 filed on Nov. 21, 2019, the disclosures of which are all incorporated herein by reference for all purposes.

FIELD OF THE INVENTION

The present invention relates to offshore platforms and, more specifically, to support systems for tendons used to tether moored offshore platforms to sea floor anchors.

BACKGROUND OF THE INVENTION

Earlier offshore wind turbines were installed on towers or spars dug deep into the ocean floor. Accordingly, their installation was limited in water depths of at most approximately fifty feet. Of necessity then, these earlier platforms were installed relatively close to coastal areas and, depending on their number, could be unsightly. Further, the wind fields in further offshore locations are generally stronger and more consistent.

Tension-leg platforms (TLP) on the other hand can be installed in water depths of up to 6,000 feet and deeper, can be moored out of sight of land, and are cheaper than other types of O&G (oil and gas) production platforms. A TLP has a buoyant hull portion on which a platform is mounted and is held down against its own buoyancy by tethers (tendons) connected at spaced locations around the periphery of the TLP. These tethers or tendons extend downward to the seabed, where they are secured by pile or weighted anchor assemblies.

TLPs typically use multiple tethers or tendons connected at each of multiple peripheral locations, and typically there may be two to three tethers or tendons at each location. It will be readily recognized that connecting multiple tendons or tethers at a spaced location on a TLP can be difficult. The environment in which they are installed subjects them to wind and sea currents which can cause the tendons to tangle, making it difficult, if not impossible, to connect the tendons to the platform.

SUMMARY OF THE INVENTION

In one aspect, the present invention relates to a system for supporting tendons prior to their connection to a TLP.

In another aspect, the present invention relates to a tendon support system (TSS) that have a buoyancy assembly and a tethering assembly.

These and further features and advantages of the present invention will become apparent from the following detailed description, wherein reference is made to the figures in the accompanying drawings.

BRIEF DESCRIPTION OF THE DRAWINGS

FIG. 2 is a top, plan view of the TSS shown in FIG. 1.

FIG. 4 is an elevational view of a yoke used with the tethering assembly of the present invention.

FIG. 5 is a top, plan view of the yoke shown in FIG. 4.

DETAILED DESCRIPTION OF PREFERRED EMBODIMENTS

Figure 1:
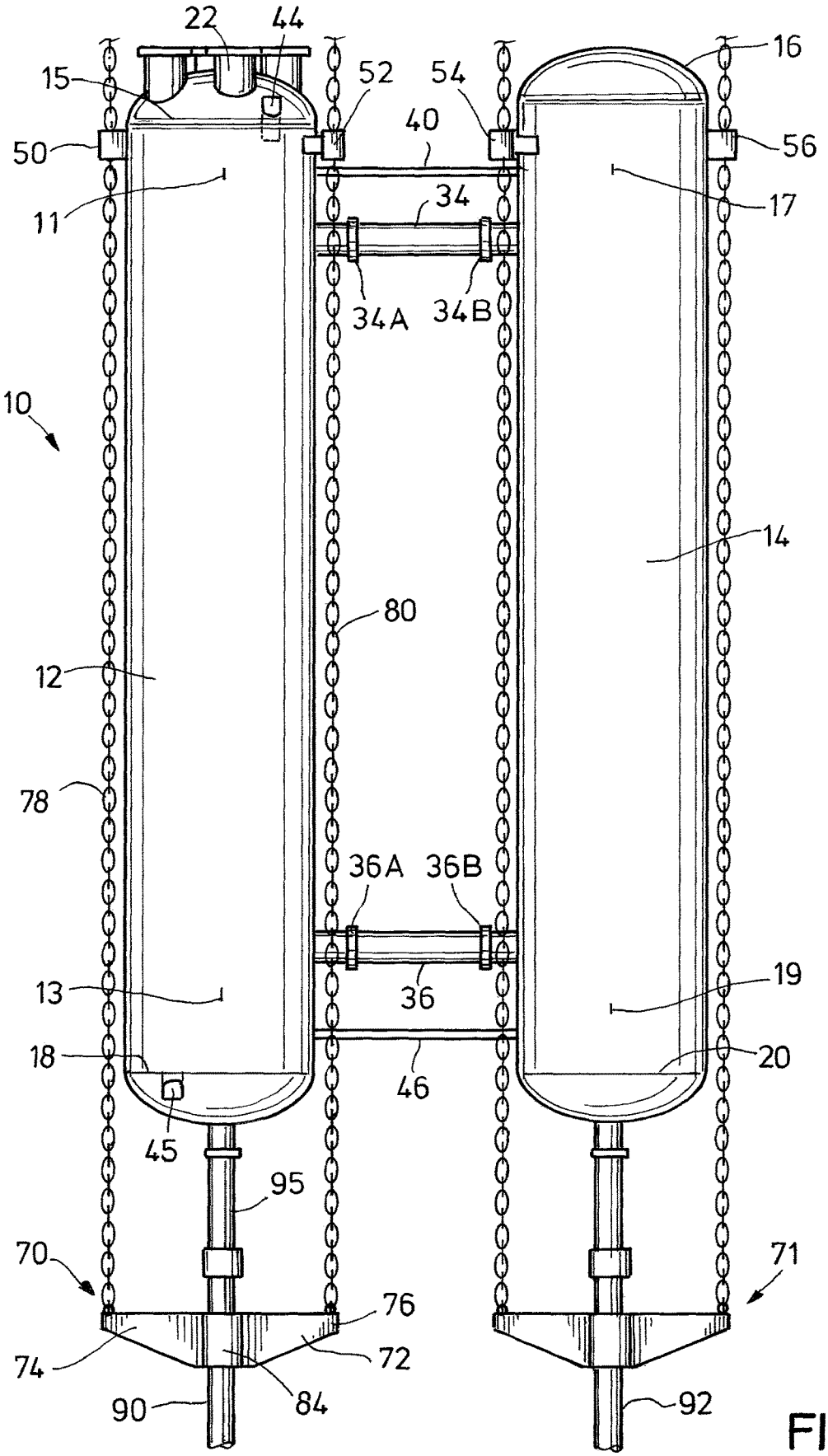
FIG. 1 is an elevational view of one embodiment of the TSS of the present invention.

Embodiments of the invention are described more fully hereafter with reference to the accompanying drawings. Elements that are identified using the same or similar reference characters refer to the same or similar elements. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Referring first to FIGS. 1-5, there is shown one embodiment of the TSS of the present invention. The embodiment of FIG. 1, shown generally as 10 comprises first and second generally cylindrical vessels 12 and 14, vessel 12 having a top cap module 15 while vessel 14 has a domed top 16. Cap module 15 comprises a generally tubular housing in which are disposed one or more nozzles 22 which can be used to form dry spaces or compartments for various operating components. Thus, one nozzle can be used to house an acoustic signal receiver and lithium battery while another nozzle could be used to house the control system for compressed air cylinders, another nozzle can house the compressed air cylinder (not shown). Still further, an air equalizing system controller could be in one of the other nozzles, a liquid level transmitter in another nozzle and a rotolatch transmitter in yet another nozzle. The various nozzles can be connected by conduits (not shown) which provide closed pathways for electrical cables and instrument tubing needed to connect the various components in the peripheral nozzles to the battery supply and the receiver, etc. Vessels 12 and 14 have domed bottoms 18 and 20, respectively. Projecting downwardly from bottoms 18 and 20 are cylindrical connectors 19 and 21, respectively.

The vessels 12 and 14 are provided with saddles 22 and 24 on vessel 12 and saddles 26 and 28 on vessel 14. The saddles allow the system 10 to rest on a flatbed truck, trailer or the like, or on a barge surface when being transported and/or being readied for service. Each of vessels 12 and 14 is provided with padeyes 11 and 13 on vessel 12 and padeyes 17 and 23 on vessel 14. Vessels 12 and 14 have hatch covers 30 and 32, respectively, over manways allowing access to the interiors of the vessels 12 and 14 for servicing and maintenance when not in use.

Figure 3:
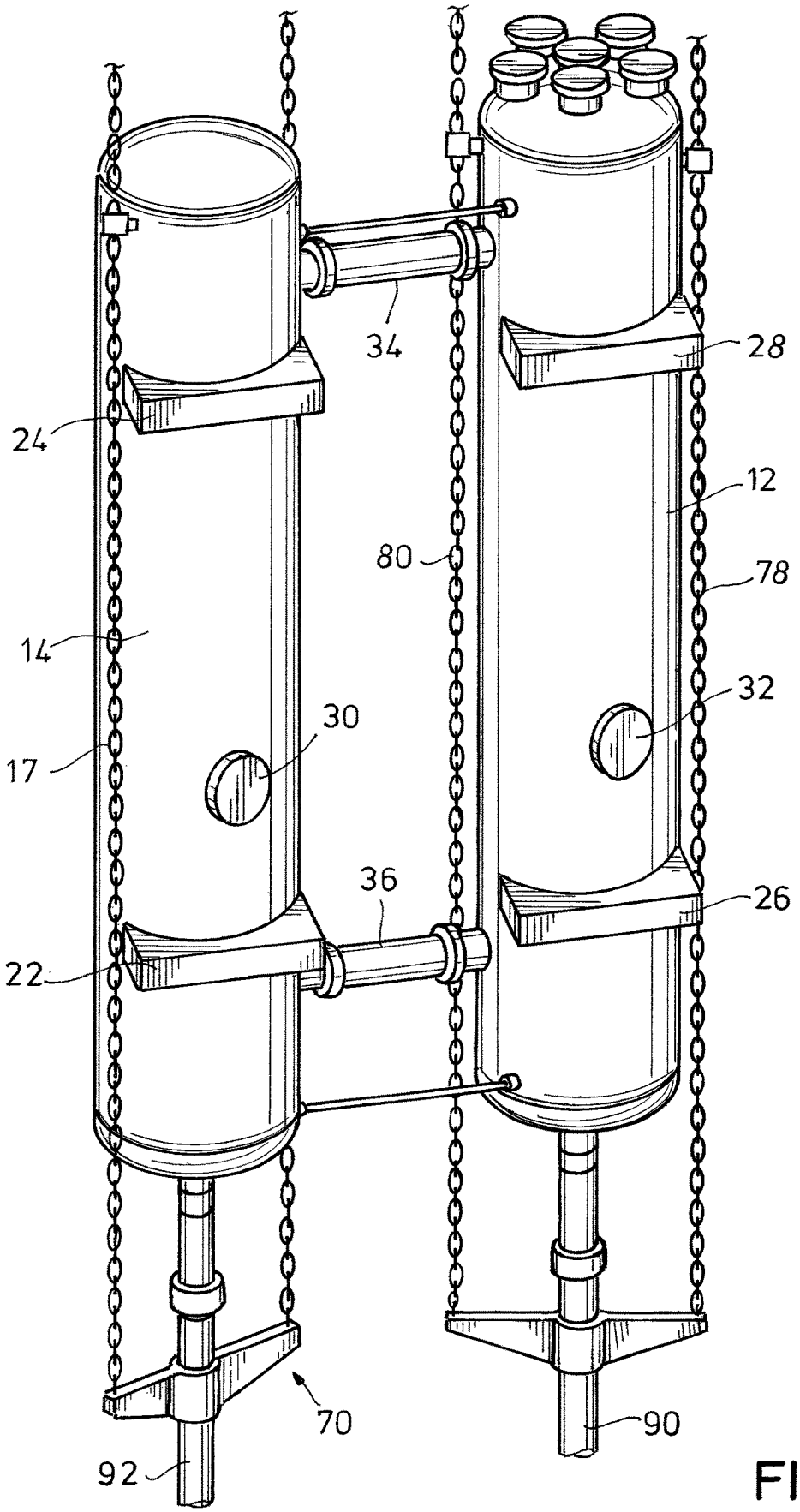
FIG. 3 is a perspective view of the TSS shown in FIG. 1.

There are upper and lower bridges 34 and 36, respectively, which rigidly interconnect vessels 12 and 14. In the embodiment of FIGS. 1-3, the bridges are in the form of tubular members connected to suitable fittings 34A, 34B, 36A, 36B secured to the vessels.

A conduit 40 interconnects and provides a path of open communication between vessel 12 and vessel 14 to provide equalization of air pressure in vessels 12 and 14. There is an air vent 44 which can be remotely operated by a controller (not shown) operatively connected to vent 44. There is a water vent 45 at the lower end of vessel 12.

There is a second conduit 46 providing a path of open communication between vessels 12 and 14 at their lower end, conduit 44 in conjunction with vent nozzle 44 and vent 45 serving to allow the free-flowing ingress and egress of water into and out of vessels 12 and 14 via vent 48. It will be appreciated that in all of the embodiments shown, there will be similar air and water vents.

There are circumferentially spaced chain connectors and guides 50 and 52 on vessel 12 and circumferentially spaced chain connectors and guides 54 and 56 on vessel 14.

The tethering assembly of the present invention comprises first and second harness assemblies shown generally as 70 and 71, respectively. Since the harnessing assemblies are substantially the same, only one will be described in detail. First harness assembly 70 comprises a yoke 72 having first and second ends 74 and 76, respectively. Ends 74 and 76 are adapted, as shown, to be connectable to chains 78 and 80, respectively, which can extend from winches (not shown) on a platform on which the wind turbine is to be mounted. As can be seen, the chains 78 and 80 extend upwardly through chain connectors and guides 50 and 52, respectively.

There is a clamp assembly 84 connected to yoke 72 midway between ends 74 and 76. As best seen in FIGS. 4 and 5, clamp assembly 84 is of a well-known type comprising first and second hinged sections which when closed form a nest for a tubular member (tendon) received therein. Clamp assembly 84 can be remotely operated from suitable controllers disposed in module 15, which of course can be remotely operated from the platform, a workship, or the like.

In the embodiments shown, it can be seen that there are first and second tendon sections 90 and 92, respectively, tendon section 90 being held in the clamp on yoke 72, tendon section 92 being held by a similar clamp on harness assembly 71. Connected to tendon 90 is a flex joint 95 which is also connected to a cylindrical fitting 19 extending from bottom dome 18 of vessel 12. A similar construction prevails with respect to harness assembly 71 and vessel 14.

Figure 6:
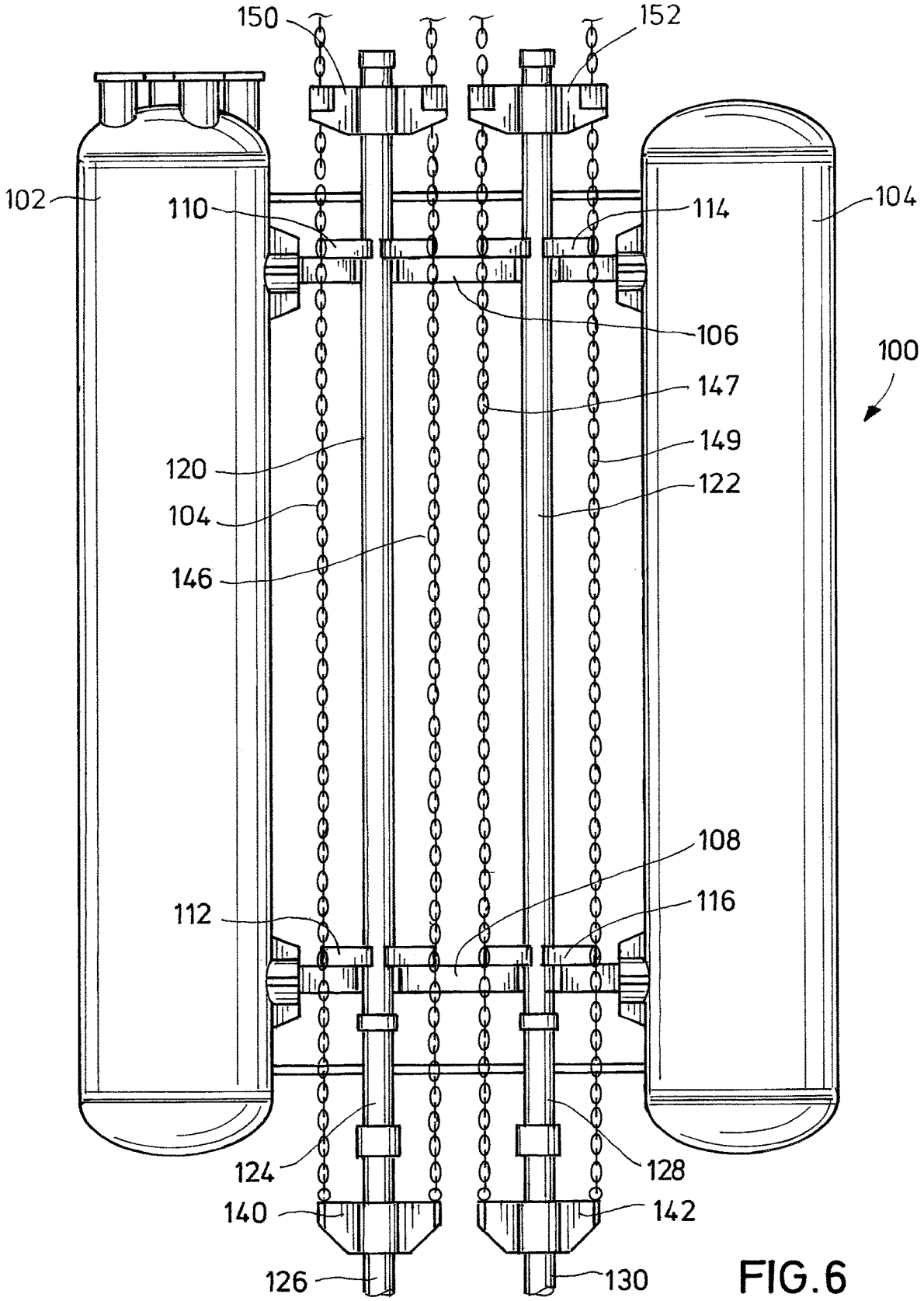
FIG. 6 is a side, elevational view of another embodiment of the TSS of the present invention.
Figure 7:
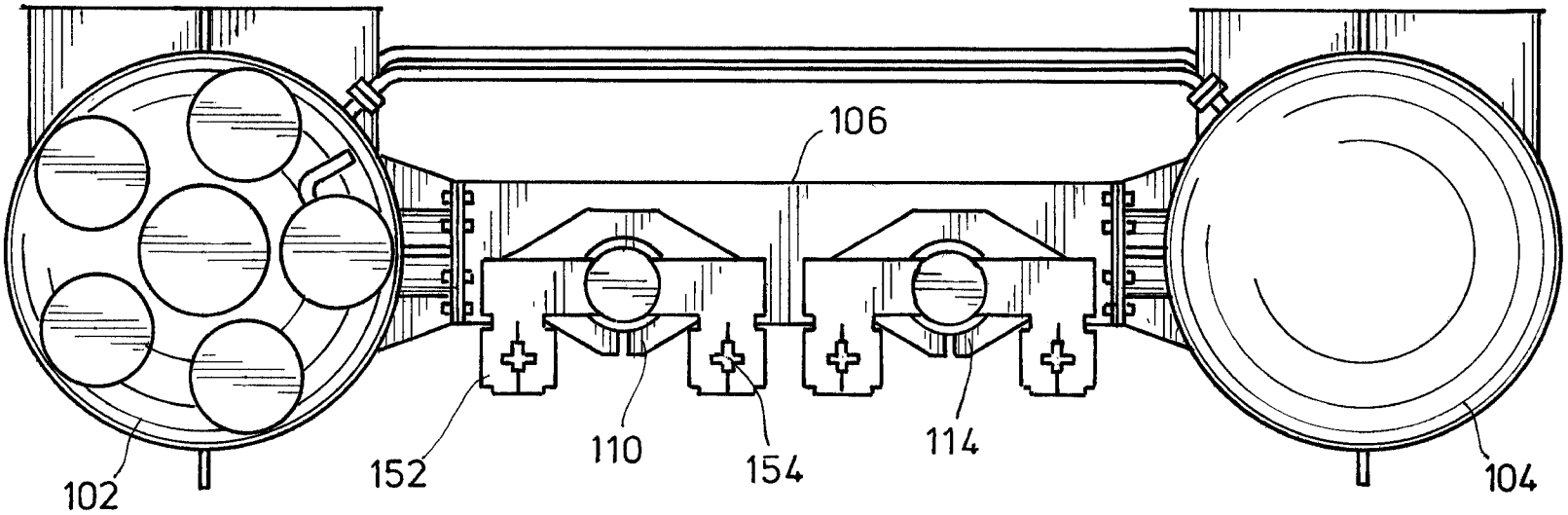
FIG. 7 is a top, plan view of the TSS shown in FIG. 6.
Figure 8:
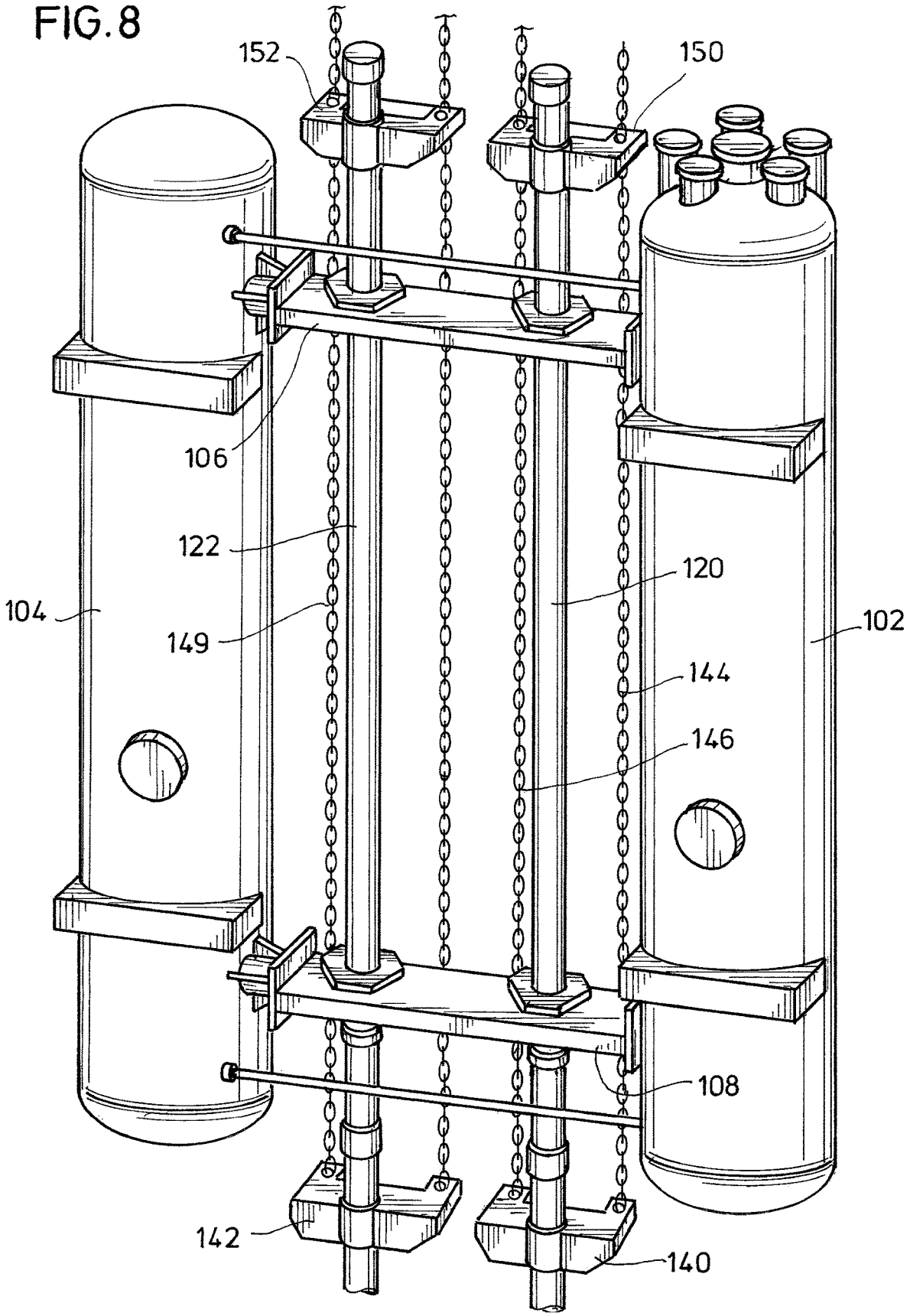
FIG. 8 is a perspective view of the TSS shown in FIG. 6.

Turning now to FIGS. 6, 7, and 8, there is shown another embodiment of the TSS of the present invention. Insofar as the floatation assembly in the embodiment of FIGS. 6-8 is substantially the same as that of FIGS. 1-5, it will accordingly not be described in detail. The system of FIGS. 6-8, shown generally as 100, comprises first and second vessels 102 and 104, respectively, vessels 102 and 104 being interconnected by a first platform 106 proximate the upper ends of the vessels 102 and 104, and a second platform 108 proximate the lower ends of vessels 102 and 104. The platforms or bridges 106 and 108 connect to suitable supports on vessels 102 and 104, as shown in the drawings.

There is a first remotely operable clamp 110 carried on platform 106 and a second remotely operable clamp 112 carried on platform 108. Likewise, there is a third remotely operable clamp 114 carried on platform 106 and a fourth remotely operable clamp 116 carried on platform 108. As can be seen, the remotely operable clamps are used to clamp first and second tendon sections 90 and 92, respectively. At its lower end, first tendon section 90 is connected via a flex joint 124 which interconnects first tendon section 90 with a third suspended tendon section 126. In like fashion, the lower end of second tendon section 92 is interconnected by a flex joint 128 to a fourth suspended tendon section 130. It will be understood that the first and second tendon sections 90 and 92 are connected to seabed anchors or the like.

There is a first harness assembly comprising a first yoke 140 of the type described above with respect to the embodiments of FIGS. 1-5 and a second yoke 142 essentially as described above with respect to the embodiments of FIGS. 1-5. As seen, yoke 140 is releasably connectable to the first suspended tendon section 126 while yoke 142 is releasably connectable to the second suspended tendon section 130.

Connected to opposed ends of yoke 140 are first and second chains 144 and 146, respectively. Releasably connected to tendon section 120 adjacent its upper end is a clamp/chain guide 150 having apertures 152 and 154 through which can extend chains 144 and 146, respectively. Chain guide 150 is in the form of a releasable clamp similar to the clamps mounted on yokes 140 and 142, in that they are remotely operable and can releasably clamp a tendon section. To this end, first tendon section 120 is releasably clamped in clamp/chain guide 150.

In a similar manner described above, there are third and fourth chains 147 and 149 which are connected at their lower end to yoke 142 and which extend upwardly through opposed ends of a clamp/chain guide 152 which is releasably connected to a second tendon section 122. As can be seen, the various chains extend upwardly from chain guides 150 and 152 so as to be connectable to a winch or the like mounted on the platform under consideration.

In the descriptions above, reference has been made to a flex joint, e.g., flex joints 124 and 128. The flex joints accommodate flexing stresses which can occur on the tendons during the installation. The flex joints can comprise a section of flexible hose which is of the heavy duty, high strength type used in transferring petroleum products such as crude oil, diesel, gasoline, etc. A "petroleum hose" used herein as the flex joint can be a wire- or steel-mesh reinforced rubber hose of a type well known in the art. Obviously, connection of the flex joint to the tendon sections can be accomplished by flange connections and other well-known connections of tubular members.

It will be readily appreciated from the above description that at least two tendons can be manipulated or maneuvered by the support system of the present invention in such a way that they are maintained sufficiently spaced to substantially obviate any tangling between the tendons 90 and 92 when they are in the process of being connected to the platform.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A tendon support system comprising:

a flotation assembly comprising:

a first vessel having a first end and a second end;

a second vessel having a first end and a second end;

a first bridge connecting said first and second vessels proximate said first ends;

a second bridge connecting said first and second vessels proximate said second ends; and a tethering assembly comprising:

first and second harness assemblies releasably connectable to said flotation assembly, each of said harness assemblies including a selectively releasable clamp adapted to receive a tendon section.

2. The system of claim 1, wherein said first bridge comprises a first platform having first and second ends connectable to said first and second vessels, respectively, and said second bridge comprises a second platform having third and fourth ends connectable to said first and second vessels, respectively.

3. The system of claim 2, wherein there are first and second selectively releasable clamps connected to said first platform and third and fourth selectively releasable clamps connected to said second platform.

4. The system of claim 3, wherein said first, second, third, and fourth clamps are selectively remotely operable.

5. The system of claim 3, wherein said first and third clamps are adapted to releasably, selectively clamp a first tendon section and said second and fourth clamps are adapted to releasably, selectively clamp a second tendon section.

6. The system of claim 1, wherein said first harness assembly comprises a first yoke having first and second ends, and a first yoke clamp mounted on said first yoke between said first and second ends, said first yoke clamp being adapted to selectively, releasably connect to said first tendon.

7. The system of claim 6, wherein said second harness assembly comprises a second yoke having third and fourth ends, and a second yoke clamp mounted on said second yoke between said third and fourth ends, said second yoke being adapted to selectively releasably connect to said second tendon.

8. The system of claim 7, wherein said first and second yoke clamps are remotely operable.

9. The system of claim 7, further comprising a first flexible connector adapted to connect said first tendon section to a third tendon section held by said first yoke clamp and, a second flexible connector adapted to connect said second tendon section to a fourth tendon section held by said second yoke clamp.

10. The system of claim 9, wherein each of said first and second flexible connectors comprise a wire reinforced rubber hose.

11. The system of claim 7, wherein said first tendon section has an upper end and a lower end, and said second tendon section has an upper end and a lower end.

12. The system of claim 11, wherein there is a first chain guide releasably connectable to said first tendon proximate its first end and a second chain guide releasably connectable to said second tendon proximate its first end.

13. The system of claim 12, wherein said first chain guide comprises first and second hinged arms, respectively, said first and second hinged arms having first and second apertures, respectively, adapted to receive a chain, and said second chain guide comprises third and fourth hinged arms, said third and fourth hinged arms having third and fourth apertures, respectively, adapted to receive a chain.

14. The system of claim 13, wherein there is a first chain connectable to said first yoke proximate said first end, and a second chain connectable to said first yoke proximate said second end, said first and second chains being receivable through said first and second apertures in said first and second hinged arms, and there is a third chain connectable to said second yoke proximate said third end and a fourth chain connectable to said second yoke proximate said fourth end, said third and fourth chains being receivable through said third and fourth apertures in said third and fourth hinged arms.

15. The system of claim 1, wherein said first bridge comprises a tubular member having first and second ends connectable to said first and second vessels, respectively, and said second bridge comprises a second tubular member having third and fourth ends connectable to said first and second vessels, respectively.

16. The system of claim 15 wherein said first harness assembly comprises a first yoke having a first end and a second end, and a first clamp mounted on said first yoke between said first and second ends of said first yoke, said first clamp being selectively operable to hold a first tendon section.

17. The system of claim 16, wherein said second harness assembly comprises a second yoke having a first end and a second end, and a second clamp mounted on said second yoke between said first and second ends of said second yoke, said second clamp being selectively operable to releasably hold a second tendon section.

18. The system of claim 17, wherein said first vessel has first and second circumferentially spaced chain guides, and said second vessel has third and fourth circumferentially spaced chain guides.

19. The system of claim 18, wherein said first yoke has first and second chain connectors adapted to connect to first and second chains, respectively, and there is a first chain connectable to said first chain connector and receivable through said first chain guide on said first vessel, and a second chain connectable to said second chain connector and receivable through said second chain guide on said first vessel.

20. The system of claim 19, wherein said second yoke has third and fourth chain connectors adapted to connect to third and fourth chains, respectively, and there is a third chain connectable to said third chain connector and receivable through said third chain guide on said second vessel, and a fourth chain connectable to said fourth chain connector and receivable through said fourth chain guide on said second vessel.

21. The system of claim 17, wherein said first vessel has a first connector on said bottom end, and there is a first flexible link connectable to said first connector on said first vessel and a third tendon section held by said first clamp, and a second flexible link connectable to said second connector on said second vessel and a fourth tendon section held by said second clamp.

22. The system of claim 21, wherein there is a rotolatch between said first flexible connector and said first tendon section, and there is a second rotolatch between said second flexible connector and said second tendon section.

23. The system of claim 21, wherein each of said first and second flexible connectors comprise a wire reinforced rubber hose.

* * * * *